US008608630B2

(12) United States Patent
Wu

(10) Patent No.: US 8,608,630 B2
(45) Date of Patent: Dec. 17, 2013

(54) ELASTIC ROPE-TYPE ABDOMINAL EXERCISER

(76) Inventor: Dong-Her Wu, Chang Hua Hsien (TW)

( * ) Notice: Subject to any disclaimer, the term of this patent is extended or adjusted under 35 U.S.C. 154(b) by 180 days.

(21) Appl. No.: 13/360,833

(22) Filed: Jan. 30, 2012

(65) Prior Publication Data

US 2013/0157822 A1 Jun. 20, 2013

(30) Foreign Application Priority Data

Dec. 20, 2011 (TW) ..... 100224096 A

(51) Int. Cl.
*A63B 21/00* (2006.01)

(52) U.S. Cl.
USPC ..... 482/126; 482/121; 482/124

(58) Field of Classification Search
USPC ..... 482/126, 124, 121
See application file for complete search history.

(56) References Cited

U.S. PATENT DOCUMENTS

| | | | | | |
|---|---|---|---|---|---|
| 5,637,066 | A | * | 6/1997 | Chang | 482/126 |
| 5,651,755 | A | * | 7/1997 | Chen | 482/128 |
| 5,700,232 | A | * | 12/1997 | Clausen et al. | 482/125 |
| 5,746,686 | A | * | 5/1998 | Berman et al. | 482/125 |
| 5,749,815 | A | * | 5/1998 | Lipps | 482/122 |
| 5,913,756 | A | * | 6/1999 | Glaser | 482/128 |
| 5,954,622 | A | * | 9/1999 | Olschansky et al. | 482/123 |
| 7,115,079 | B2 | * | 10/2006 | Yu | 482/126 |
| D589,574 | S | * | 3/2009 | Tsai | D21/692 |
| 2005/0143232 | A1 | * | 6/2005 | Hung | 482/126 |

* cited by examiner

*Primary Examiner* — Jerome W Donnelly
(74) *Attorney, Agent, or Firm* — Jackson IPG PLLC

(57) ABSTRACT

An elastic rope-type abdominal exerciser includes a main body, a retractable rod, and a lower cover. The main body includes a bottom board having an insertion hole, an inner pipe at a central portion thereof for the retractable rod to slide thereon, an elastic strip which is transversely connected to two sides of the bottom board, and a pair of sliding axles which are located close to two sides of the inner pipe and above the elastic strip. The retractable rod includes a hook pipe at a front end thereof. The hook pipe has a hook board on an outer wall thereof. The hook pipe is positioned by a screw. The lower cover is coupled to the main body. The lower cover has a slot corresponding in position to the center of the elastic strip. The present invention is simple in configuration and convenient for assembly.

2 Claims, 7 Drawing Sheets

Fig. 1-A
PRIOR ART

ELASTIC ROPE-TYPE ABDOMINAL EXERCISER

BACKGROUND OF THE INVENTION

1. Field of the Invention

The present invention relates to an elastic rope-type abdominal exerciser, and more particularly to an exerciser for exercising both hands and massaging abdomen.

2. Description of the Prior Art

A conventional abdominal exerciser can be operated automatically or manually. When in use, the abdominal exerciser is transversely put on the abdomen of the user and the user applies a force inward by hands to press the abdominal exerciser and the abdominal exerciser will be pushed outward by the abdomen for exercise.

As shown in FIG. 1 and FIG. 1-A, Taiwanese Patent Publication No. 475437 discloses a multi-function device for exercising abdomen and waist. The device comprises a main body 5 having grasp portions 51 at two sides thereof and a sleeve 52 at a central portion thereof. The sleeve 52 has a first hook member 521 on an outer wall at a rear end thereof. A guide rod 6 is inserted and slid in the sleeve 52. The guide rod 6 has a second hook member 61 on an outer wall at a front end thereof. A pull strip 62 is connected between on the first hook member 521 and the second member 61. The rear end of the guide rod 6 is connected to a cushion 7. When the device is packed, the main body 5, the guide rod 6 and the pull strip 62 will be detached to reduce the size for packing and to lower the cost. When the device is stored, the main body 5 and the guide rod 6 must be separated. Because the guide rod 6 is exposed, the guide rod 6 may be deformed by an external force to influence its smoothness of sliding or cannot be used anymore.

Accordingly, the inventor of the present invention has devoted himself based on his many years of practical experiences to solve these problems.

SUMMARY OF THE INVENTION

The primary object of the present invention is to provide an elastic rope-type abdominal exerciser which comprises a main body, a retractable rod, and a lower cover. The main body is a casing which is symmetrical left and right. The main body comprises two upper grasp portions at two sides thereof, a bottom board having an insertion hole for insertion of the retractable rod, an inner pipe at a central portion thereof for the retractable rod to slide thereon, an elastic strip which is transversely connected to two sides of the bottom board, and a pair of sliding axles which are located close to two sides of the inner pipe and above the elastic strip. The retractable rod is a hollow cylinder. The retractable rod comprises a hook pipe at a front end thereof. The hook pipe has a hook board on an outer wall thereof. The hook pipe is positioned by a screw. The rear end of the retractable rod is connected to a cushion. The lower cover is coupled to the main body and corresponds in shape to the main body. The lower cover has two lower grasp portions at two sides thereof and a slot corresponding in position to the center of the elastic strip for the user to pull the elastic strip to engage with the hook board or disengage from the hook board. When in use, the central portion of the elastic strip is pulled to engage with the hook board. The cushion is used to lean against the abdomen of the user. The user holds the grasp portions to apply force toward the abdomen. The retractable rod is moved forward to slide on the inner pipe, and the elastic strip is also pulled forward along with the hook board through the two sliding axles to generate an elastic force. When the user releases his/her hands, the elastic strip will return to its original position by the elastic force to push the hook board backward. At the same time, the retractable rod is pushed back. The user can repeat this action. When packing or storing the present invention, the elastic strip can be pulled to disengage from the hook board through the slot, so that the retractable rod is pushed forward to wrap the inner pipe. At this time, the retractable rod won't cooperate with elastic strip. The present invention is simple in configuration and convenient for assembly.

BRIEF DESCRIPTION OF THE DRAWINGS

FIG. 1-A is a schematic view of the conventional abdominal exerciser in a retracted state;

FIG. 4-A is an enlarged view showing the elastic strip engaging with the hook board of the preferred embodiment of the present invention;

DETAILED DESCRIPTION OF THE PREFERRED EMBODIMENTS

Embodiments of the present invention will now be described, by way of example only, with reference to the accompanying drawings.

Figure 1:
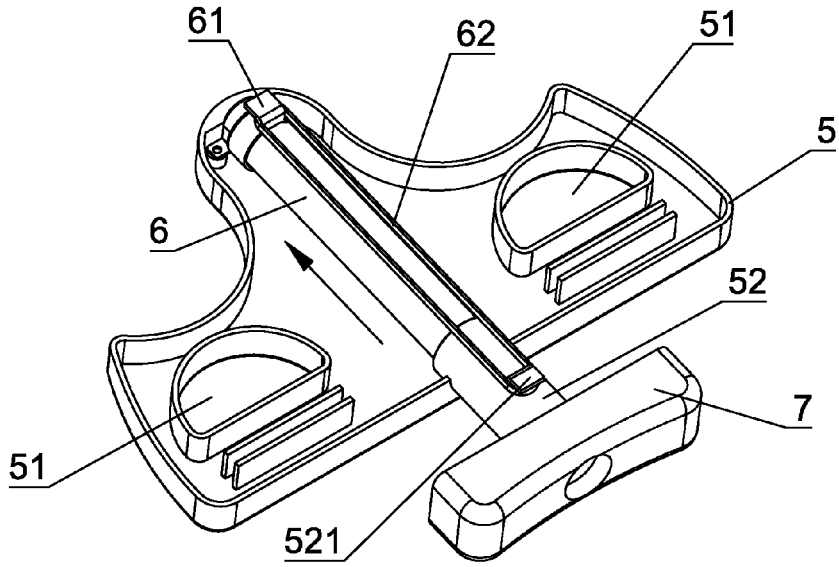
Fig. 1 PRIOR ART
FIG. 1 is a perspective view of a conventional abdominal exerciser.
Figure 1:
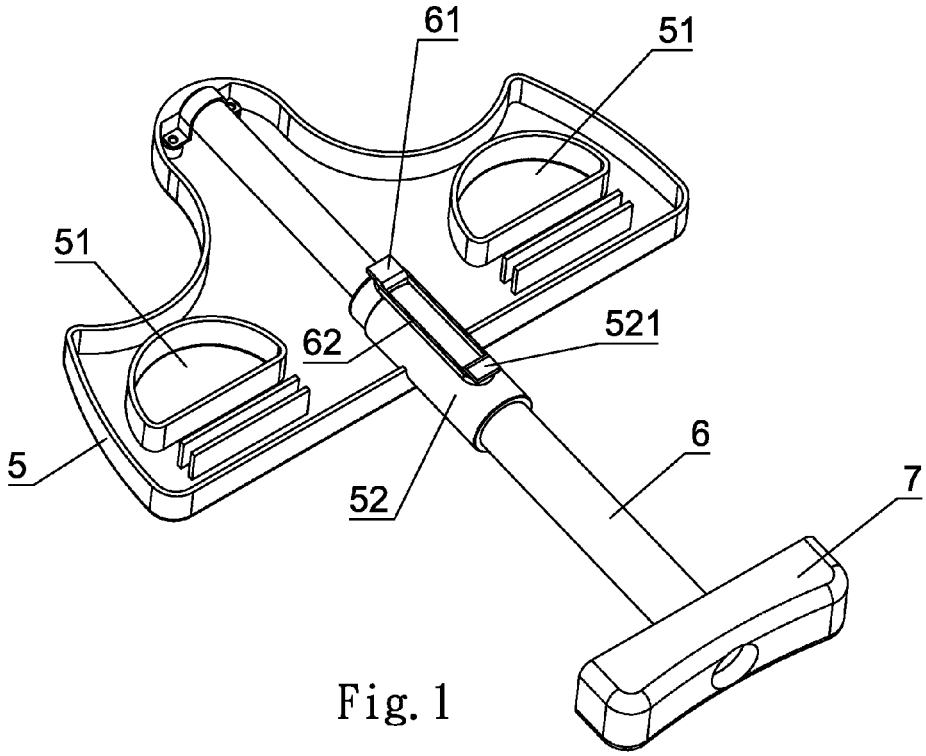
Fig. 1 PRIOR ART
Figure 2:
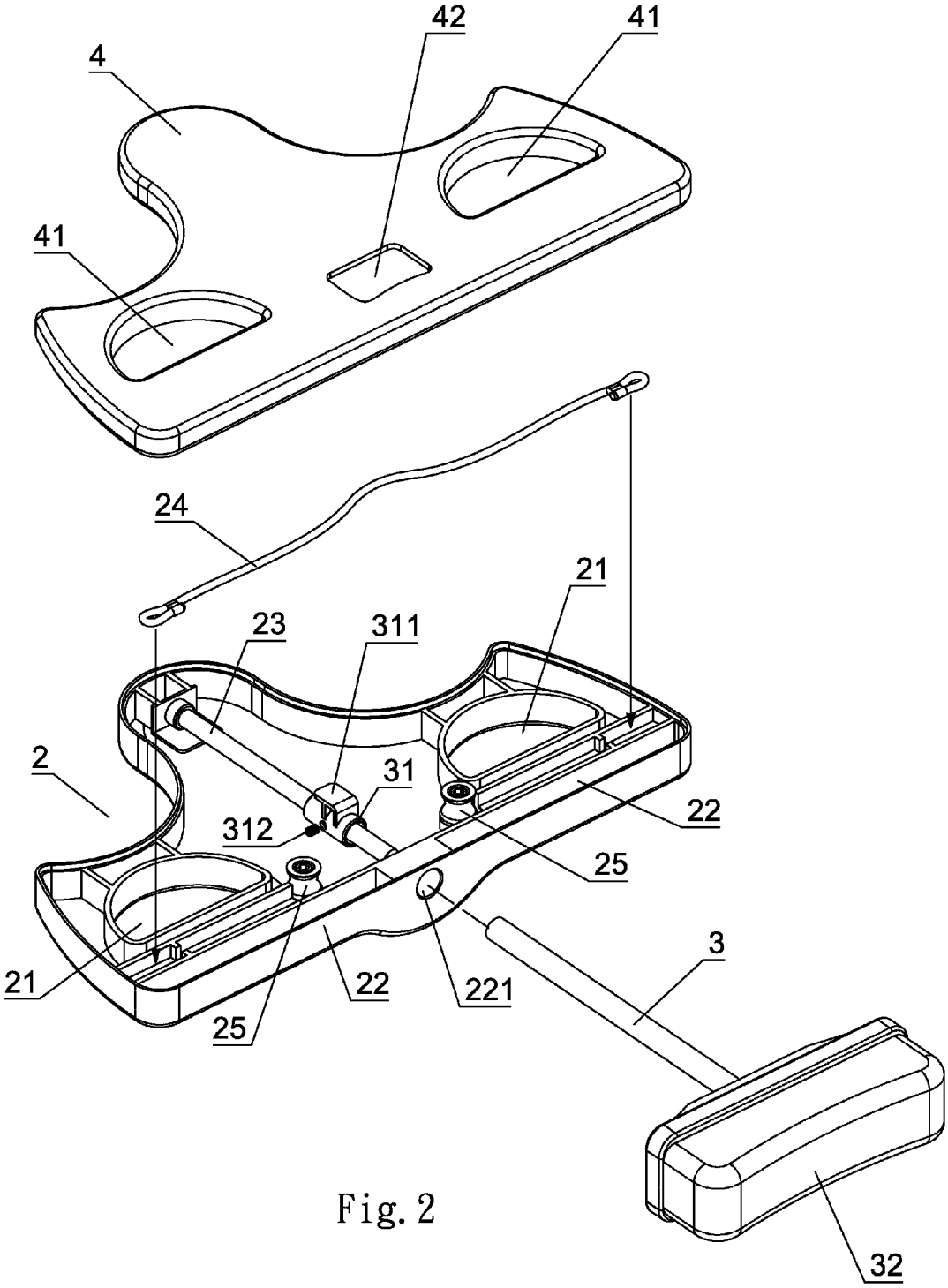
FIG. 2 is an exploded view according to a preferred embodiment of the present invention.
Figure 3:
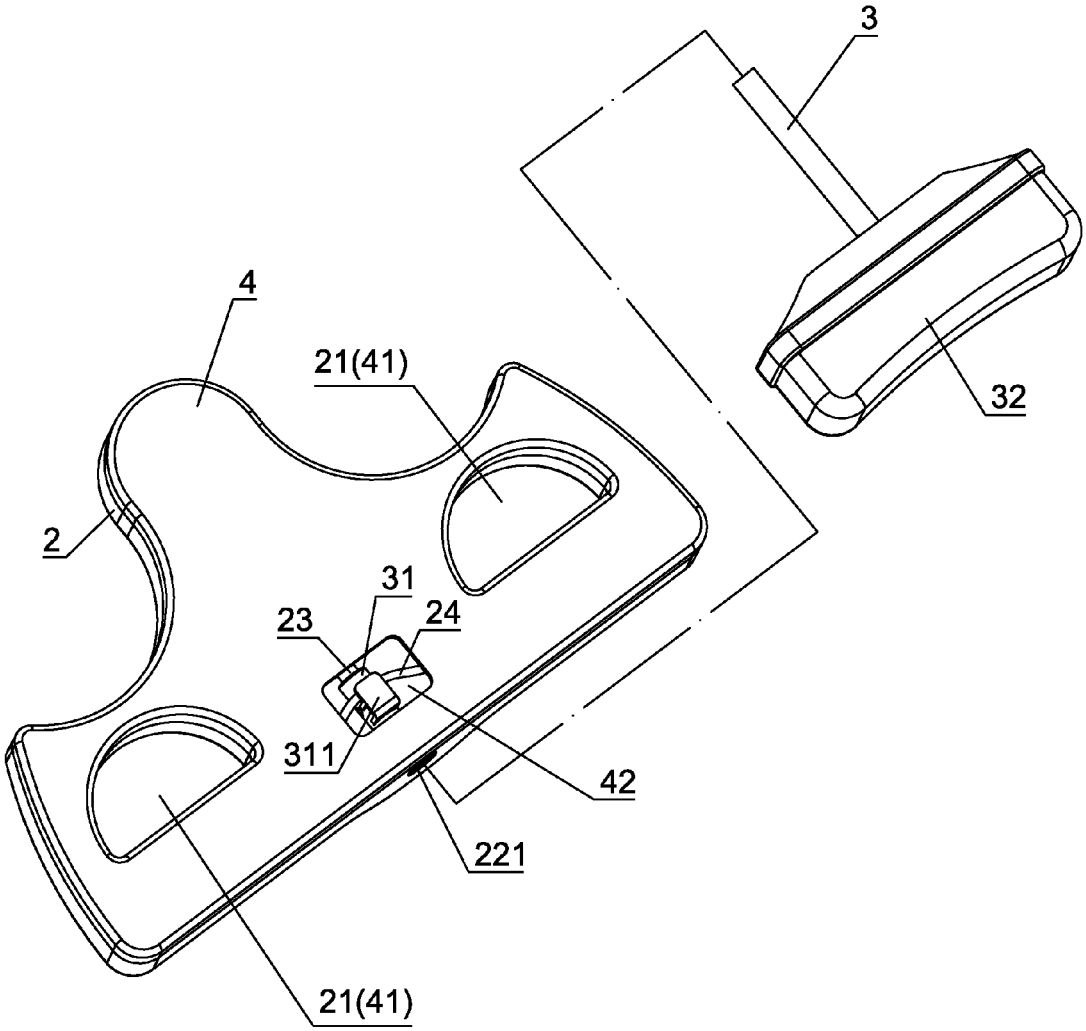
FIG. 3 is a perspective view according to the preferred embodiment of the present invention.
Figure 4:
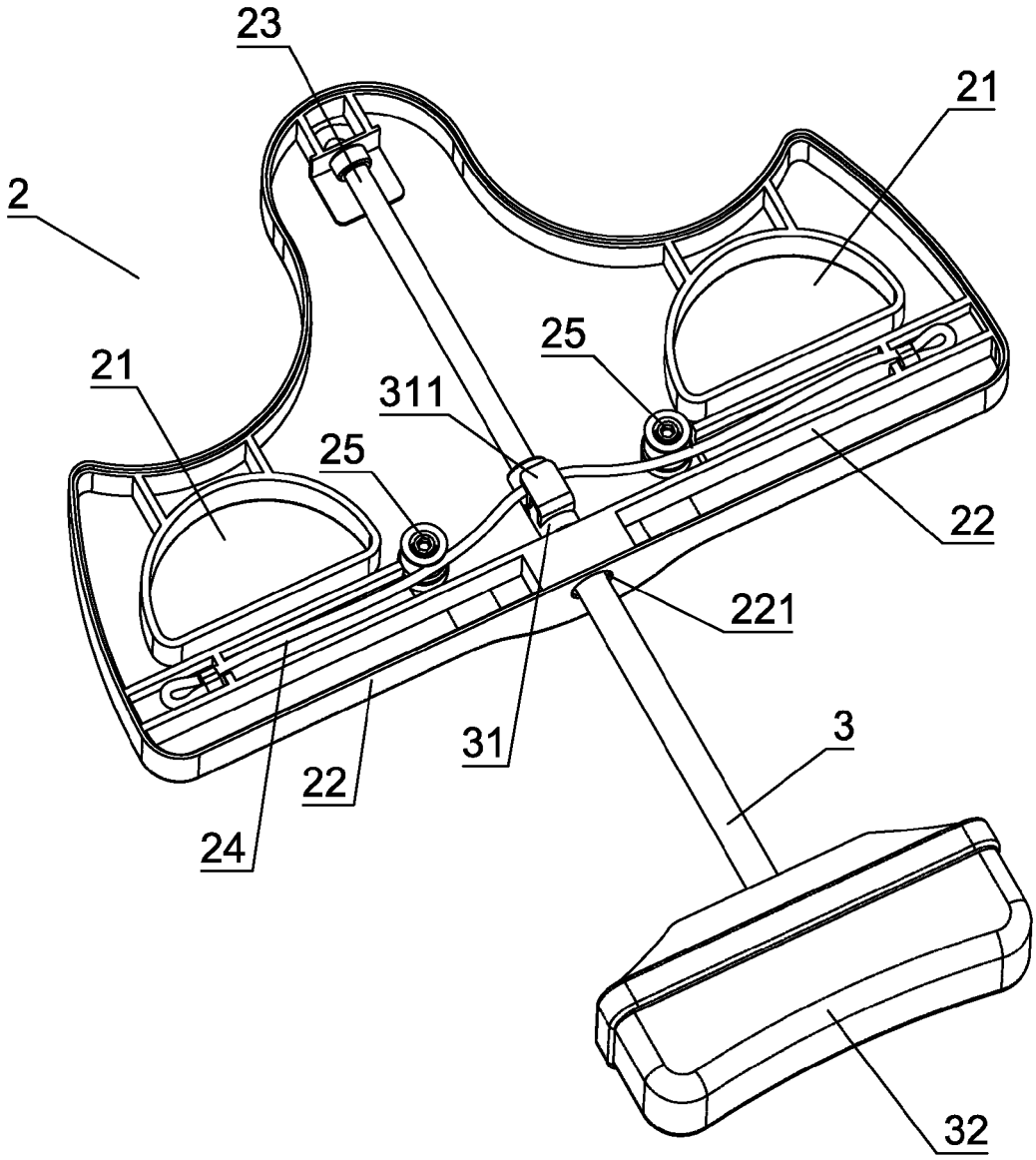
FIG. 4 is a perspective view showing the main body and the retractable rod of the preferred embodiment of the present invention.

As shown in FIG. 2 through FIG. 4 and FIG. 4-A, the present invention comprises a main body 2, a retractable rod 3, and a lower cover 4.

The main body 2 is an upper casing which is symmetrical left and right. The main body 2 comprises two upper grasp portions 21 at two sides thereof for the user to hold thereon, a bottom board 22 having an insertion hole 221 for insertion of the retractable rod 3, an inner pipe 23 at a central portion thereof for the retractable rod 3 to slide thereon, an elastic strip 24 which is transversely connected to two sides of the bottom board 22, and a pair of sliding axles 25 or rollers which are located close to two sides of the inner pipe 23 and above the elastic strip 24 for the elastic strip 24 to change the direction of the applied force and to retract.

The retractable rod 3 is a hollow cylinder sliding on the inner pipe 23 of the main body 2. The retractable rod 3 comprises a hook pipe 31 at a front end thereof.

The hook pipe 31 has a hook board 311 on an outer wall thereof. The hook pipe 31 is positioned by a screw 312 for hooking a central portion of the elastic strip 24. The rear end of the retractable rod 3 is connected to a cushion 32 for the user to lean against the cushion 32.

The lower cover 4 is coupled to the main body 2 and corresponds in shape to the main body 2. The lower cover 4 has two lower grasp portions 41 at two sides thereof and a slot 42 corresponding in position to the central portion of the elastic strip 24 for the user to pull the elastic strip 24 to engage with the hook board 311 or disengage from the hook board 311. The present invention can be easily stored to reduce its size.

Figure 5:
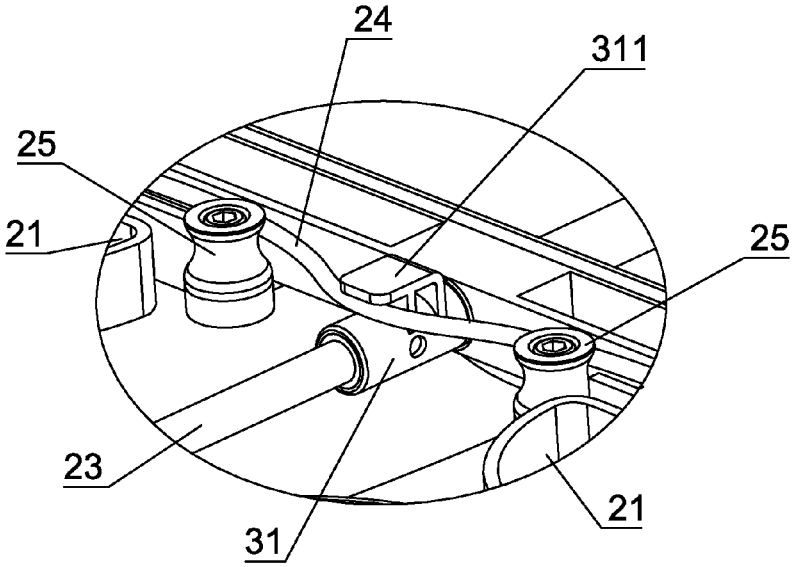
FIG. 5 is a schematic view of the preferred embodiment of the present invention in a retracted state.
Figure 5:
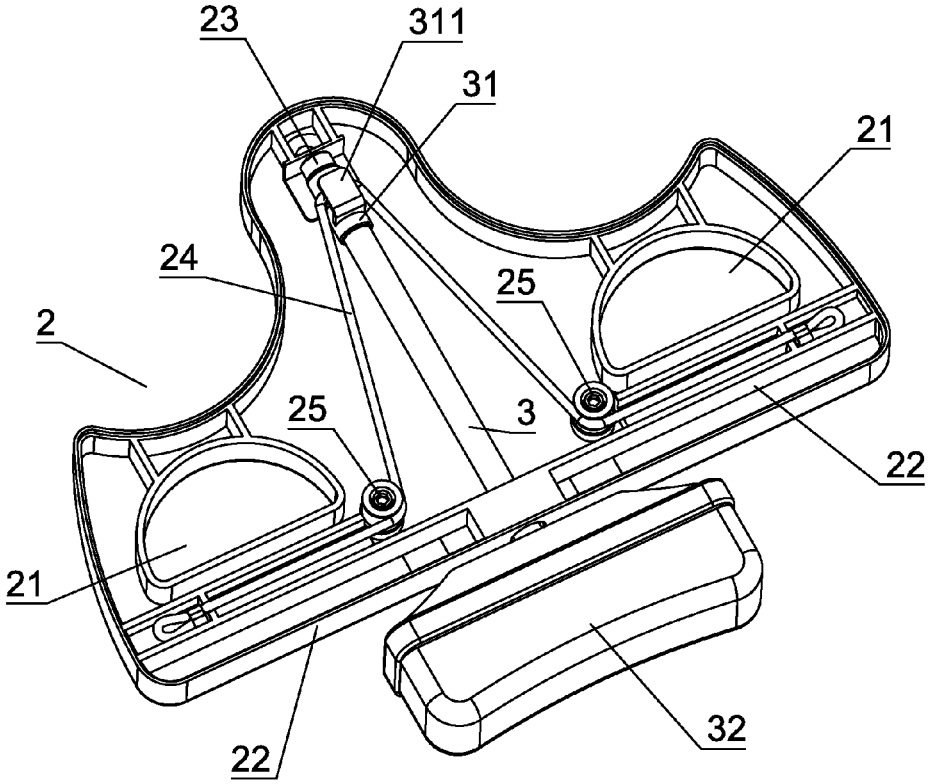
Figure 6:
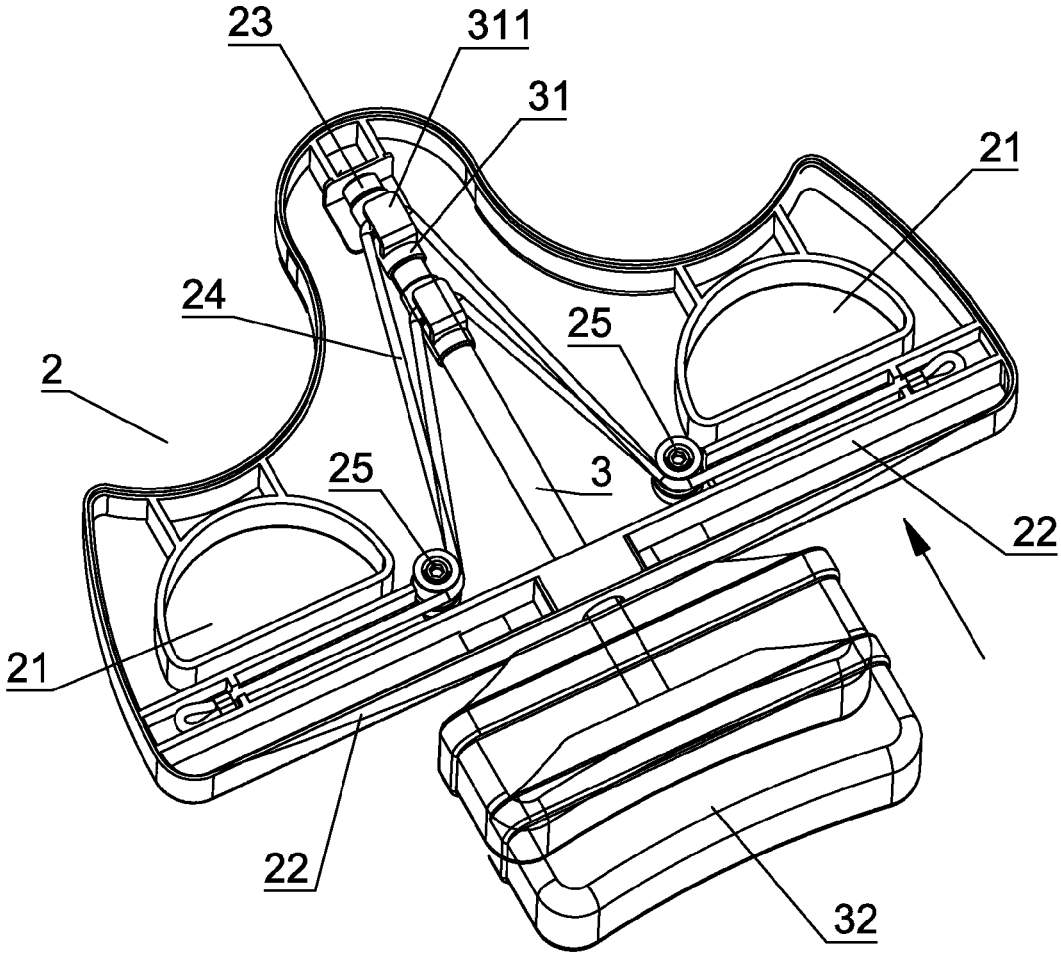
FIG. 6 is a schematic view showing the elastic operation of the elastic strip of the preferred embodiment of the present invention.
Figure 7:
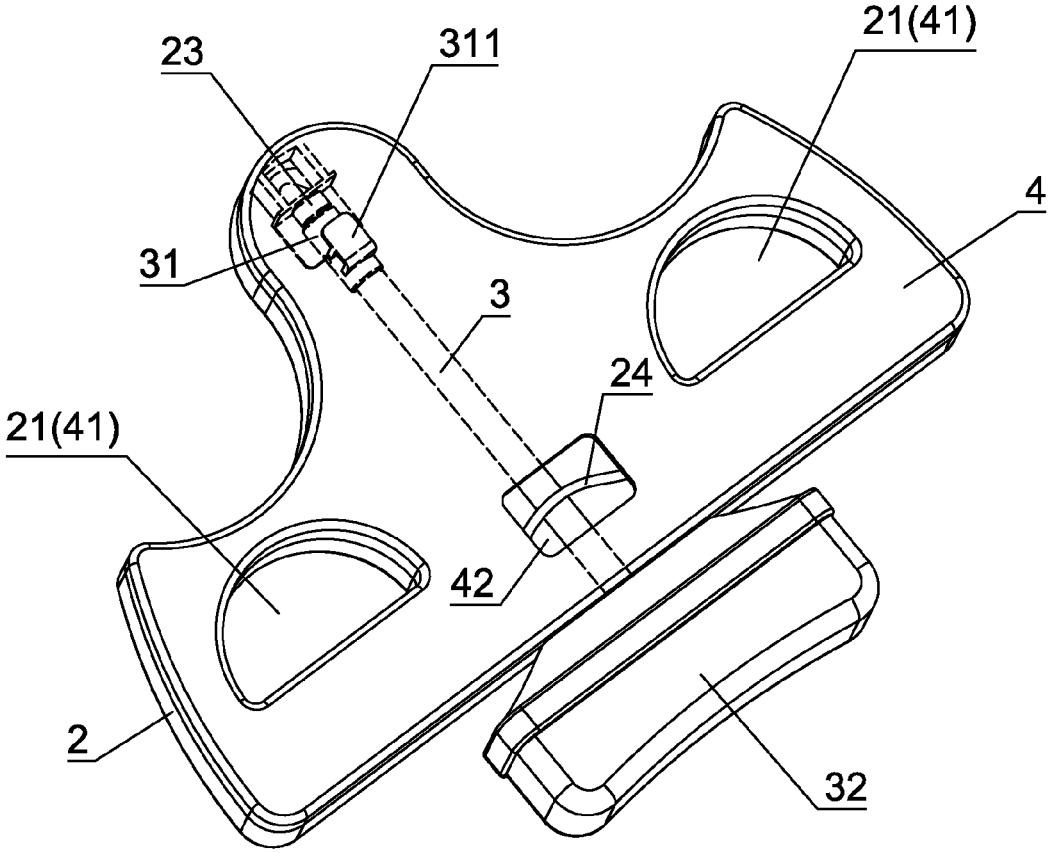
FIG. 7 is a schematic view showing the retractable rod retraced in the main body of the preferred embodiment of the present invention.

Referring to FIG. 2, FIG. 4 through FIG. 7 and FIG. 4-A, the retractable rod 3 passes the insertion hole 22, and the hook pipe 31 is locked at the front end of the retractable rod 3. The elastic strip 24 is secured and located close to the bottom board 22. The lower cover 4 is coupled to the main body 2. When in use, the retractable rod 3 is pulled outward to its utmost. Through the slot 42 (as shown in FIG. 2), the user pulls the central portion of the elastic strip 24 to engage with the hook board 311 (as shown in FIG. 4 and FIG. 4-A). The cushion 32 is used to lean against the abdomen of the user. The user holds the grasp portions 21 (41) to apply force toward the abdomen. The retractable rod 3 is moved forward to slide on the inner pipe 23, and the elastic strip 24 is also pulled forward along with the hook board 311 through the two sliding axles 25 to generate an elastic force (as shown in FIG. 5). When the user releases his/her hands, the elastic strip 24 will return to its original position by the elastic force to push the hook board 311 backward. At the same time, the retractable rod 3 is pushed back as shown in FIG. 4. The user can repeat this action. When packing or storing the present invention, the elastic strip 24 can be pulled to disengage from the hook board 311 through the slot 42 (as shown in FIG. 2), so that the retractable rod 3 is pushed forward to wrap the inner pipe 23 (as shown in FIG. 7). At this time, the retractable rod 3 won't cooperate with elastic strip 24. The present invention is simple in configuration and convenient for assembly.

Accordingly, the retractable rod of the present invention can be retraced to reduce its size when stored.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An elastic rope-type abdominal exerciser, comprising a main body, a retractable rod and a lower cover, the main body and lower cover being coupled with each other to form a casing which is symmetrical left and right, the main body and the lower cover having upper and lower grasp portions at two sides thereof, a rear end of the retractable rod being coupled to a cushion;

the main body comprising a bottom board having an insertion hole, an inner pipe at a central portion thereof, an elastic strip which is transversely connected to two sides of the bottom board and a pair of sliding axles which are located close to two sides of the inner pipe and above the elastic strip;

the retractable rod being a hollow cylinder which slides on the inner pipe of the main body, the retractable rod comprising a hook pipe at a front end thereof, the hook pipe having a hook board on an outer wall thereof, the hook pipe being positioned by a screw;

the lower cover having a slot corresponding in position to a central portion of the elastic strip;

wherein when the central portion of the elastic strip engages with the hook board, the retractable rod is reciprocated to slide on the inner pipe by the elastic strip through the sliding axles, when the elastic strip disengages from the hook board, the retractable rod is retracted inward and positioned.

2. The elastic rope-type abdominal exerciser as claimed in claim 1, wherein the sliding axles are rollers.

* * * * *